US005758771A

United States Patent [19]

Rose

[11] Patent Number: 5,758,771

[45] Date of Patent: Jun. 2, 1998

[54] PALLET SYSTEM

[75] Inventor: Henry H. Rose, Knoxville, Tenn.

[73] Assignee: Formall Inc. Knoxville, Tenn.

[21] Appl. No.: 707,627

[22] Filed: Sep. 5, 1996

[51] Int. Cl.[6] ..... B65D 19/00

[52] U.S. Cl. ..... 206/386; 206/391; 206/504; 108/51.1

[58] Field of Search ..... 206/386, 391, 206/394, 504; 108/51.1, 55.3, 56.3

[56] References Cited

U.S. PATENT DOCUMENTS

| | | | |
|---|---|---|---|
| 2,704,600 | 3/1955 | Despres . | |
| 2,721,689 | 10/1955 | Nye . | |
| 3,346,137 | 10/1967 | Ricci . | |
| 3,371,816 | 3/1968 | Ricci . | |
| 3,375,919 | 4/1968 | Schlager et al. . | |
| 3,495,705 | 2/1970 | Limbacher . | |
| 3,524,415 | 8/1970 | Heiman . | |
| 3,526,195 | 9/1970 | Maryonovich . | |
| 3,563,184 | 2/1971 | Angelbeck, Jr. . | |
| 3,636,888 | 1/1972 | Angelbeck, Jr. . | |
| 3,650,244 | 3/1972 | Petix et al. . | |
| 3,654,874 | 4/1972 | Skinner . | |
| 3,664,271 | 5/1972 | Wolder et al. . | |
| 3,667,403 | 6/1972 | Angelbeck, Jr. . | |
| 3,695,188 | 10/1972 | Granatstein . | |
| 3,696,761 | 10/1972 | Brown . | |
| 3,730,340 | 5/1973 | Neubert . | |
| 3,944,070 | 3/1976 | Cardwell et al. . | |
| 3,944,074 | 3/1976 | Riley | 206/504 |
| 3,948,190 | 4/1976 | Cook, III et al. . | |
| 4,042,108 | 8/1977 | Brethauer . | |
| 4,062,301 | 12/1977 | Pitchford . | |
| 4,095,769 | 6/1978 | Fengels . | |
| 4,202,448 | 5/1980 | Jaeger et al. . | |
| 4,253,569 | 3/1981 | O'Connor et al. . | |
| 4,253,570 | 3/1981 | O'Connor et al. . | |
| 4,263,855 | 4/1981 | Lawlor . | |
| 4,416,373 | 11/1983 | de Larosiere | 206/504 |
| 4,516,677 | 5/1985 | Rowland et al. . | |
| 4,580,680 | 4/1986 | Wind . | |
| 4,667,823 | 5/1987 | Wolfe, Jr. et al. . | |
| 4,890,743 | 1/1990 | Powel et al. . | |
| 4,982,858 | 1/1991 | von Holdt | 206/504 |
| 5,025,735 | 6/1991 | Chan et al. . | |
| 5,097,951 | 3/1992 | Pigott . | |
| 5,100,076 | 3/1992 | Cobane et al. . | |
| 5,105,746 | 4/1992 | Reynolds . | |
| 5,144,897 | 9/1992 | Avery . | |
| 5,310,063 | 5/1994 | Skolasinski . | |
| 5,562,047 | 10/1996 | Forney et al. | 108/51.1 |

FOREIGN PATENT DOCUMENTS

| | | |
|---|---|---|
| 856116 | 5/1940 | France . |
| 1325214 | 8/1973 | United Kingdom . |

*Primary Examiner*—David T. Fidei
*Attorney, Agent, or Firm*—Luedeka Neely & Graham P.C.

[57] ABSTRACT

A pallet system for use in the warehousing or transporting of a load comprised, for example, of strand material packages such as yarn bobbins, cones and pirns utilizes first and second sections, each including a platform portion having an upwardly-facing surface upon which a load can be positioned and a cap for covering the load positioned upon the first and second sections. An upwardly-directed lip is joined to the platform portion so as to extend along at least one side of the perimeter of the upwardly-facing surface and includes a vertically-oriented wall having an outside surface which faces away from one side of the corresponding section. A plurality of protuberances extend outwardly from the outside surface of the lip wall and a plurality of openings are disposed along the length of the lip wall. The first and second platform sections are positionable alongside one another so that the protuberances provided along the outside surface of the lip wall of one platform section are nestingly accepted by the openings provided along the outside surface of the lip wall of the other platform section for limiting the movement of one platform section relative to the other platform section.

19 Claims, 7 Drawing Sheets

PALLET SYSTEM

BACKGROUND OF THE INVENTION

This invention relates generally to pallets for supporting loads to be moved by lift trucks and relates, more particularly, to pallets which are especially well-suited for supporting packages of stranded material such as yarn bobbins, cones, pirns, or other similar types of loads for warehousing or transporting purposes.

Routinely it becomes necessary in a textile mill to replenish spent yarn packages on a creel to which access is provided by narrow creel aisles. Pallets which are large enough to provide an expansive load-supporting surface upon which a large number of strand material packages can be positioned for warehousing or transporting purposes are normally too large to be moved along a creel aisle of typical width, e.g. about two feet in width, for transport of the palletized packages along the creel aisle. Therefore, palletized strand material packages must be depalletized and transferred to a more narrow carrier for transport of the packages along a creel aisle. It would be desirable to provide a pallet capable of supporting a relatively large number of strand material packages for shipping and warehousing purposes and where the packages would not have to be de-palletized for transport of the packages along a creel aisle of typical width.

Accordingly, it is an object of the present invention to provide a new and improved pallet system having interconnecting components, which, when interconnected, provide an expansive load-supporting surface upon which a load comprised, for example, of relatively large number of strand material packages may be positioned for warehousing or transporting purposes and which, when detached from one another, may be moved along a creel aisle of typical width.

One more object of the present invention is to provide such a system having interconnected components whose capacity to be detached from one another accommodates an optimizing of use of the floor space available in a warehouse or truck van for placement of loaded pallets thereon.

Another object of the present invention is to provide such a system which accommodates a stacking of loaded pallets in layers.

Still another object of the present invention is to provide such a system which accommodates a banding of loaded pallets together.

A further object of the present invention is to provide such a system which is uncomplicated in construction and effective in operation.

SUMMARY OF THE INVENTION

This invention resides in a pallet system for use in the warehousing or transporting of loads.

The pallet system includes first and second sections each including a platform portion having an upwardly-facing surface upon which a load may be positioned and having an underside opposite the upwardly-facing surface against which the lift of a lift truck may be positioned for lifting the section. The upwardly-facing surface has a perimeter with one side extending therealong and is sized so that when the first and second sections are positioned in a side-by-side relationship, the upwardly-facing surfaces collectively provide an expansive surface for supporting a load positioned thereon. Each section also includes a plurality of feet for supporting the underside of the platform portion in an elevated condition above a floor or similar supporting surface. The feet are disposed in a spaced relationship about the perimeter of the upwardly-facing surface so that the spacing provided between adjacent feet accepts the lift forks of a lift truck directed beneath the underside of the platform portion for lifting the relatively rigid cap positionable across the load positioned upon the upwardly-facing surfaces of the first and second platform sections for covering the load.

DETAILED DESCRIPTION OF THE ILLUSTRATED EMBODIMENTS

Figure 1:
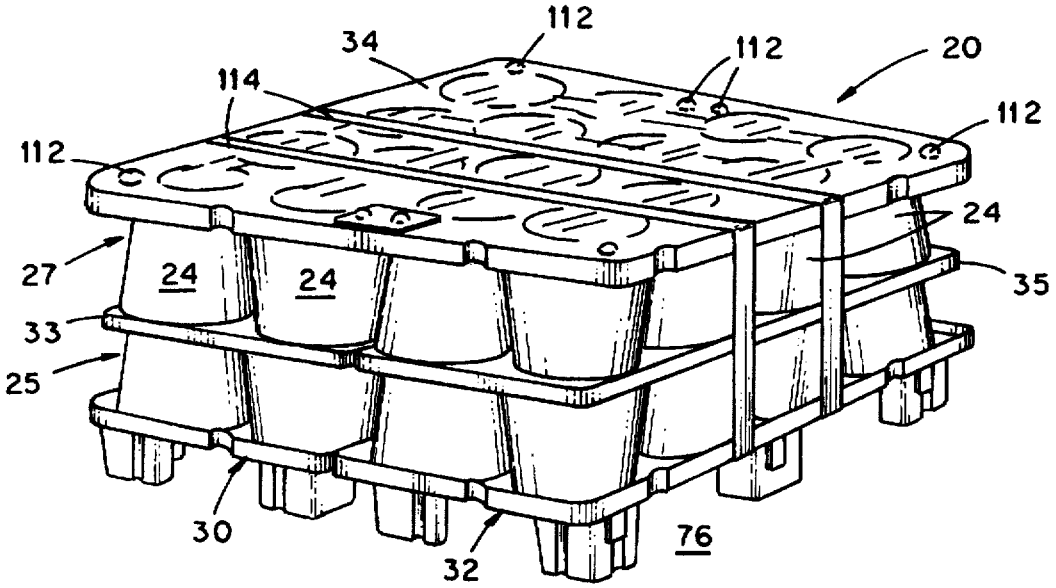
FIG. 1 is a perspective view of an assembly including a pallet system within which a plurality of yarn bobbins which have been palletized.
Figure 2:
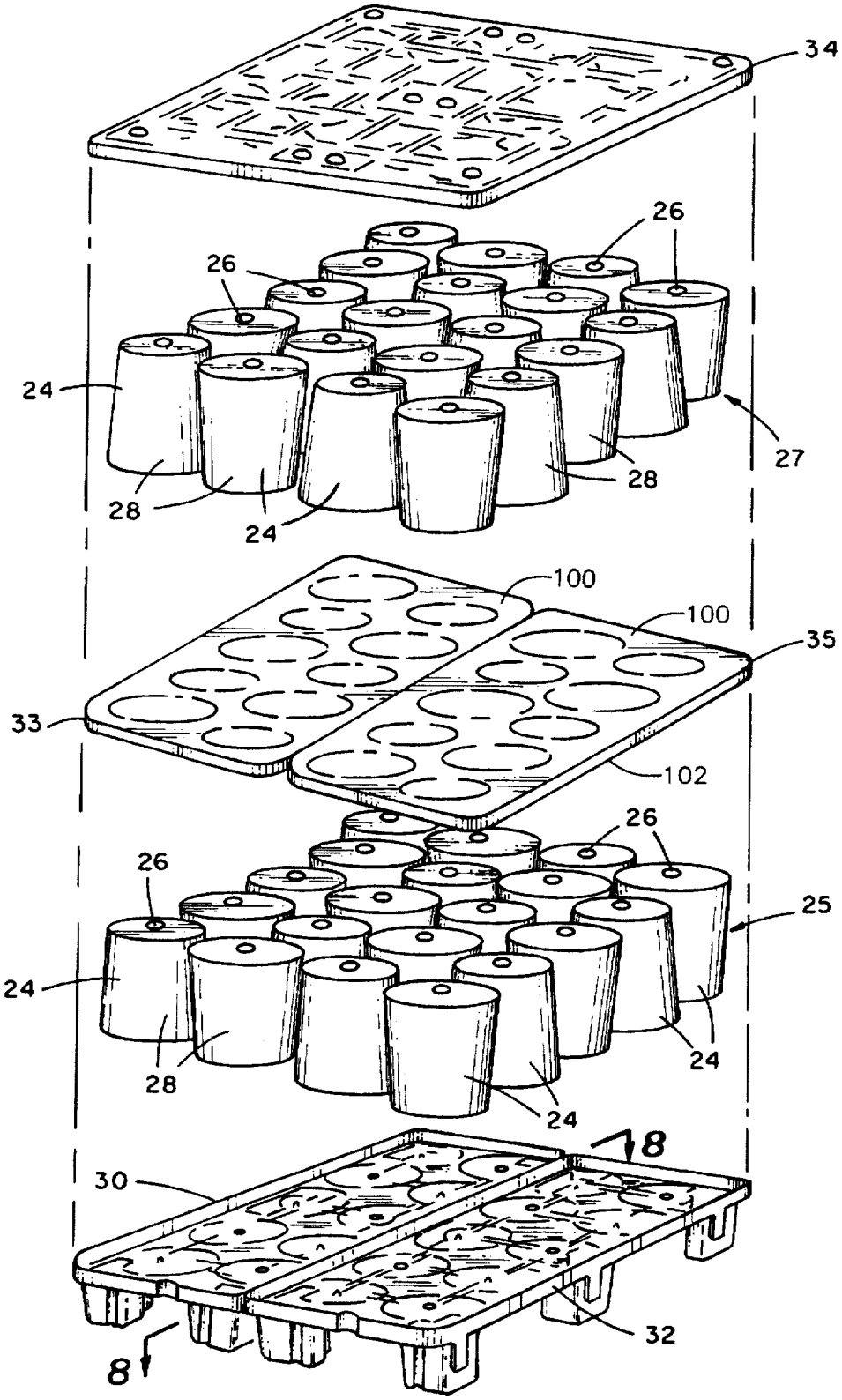
FIG. 2 is a view similar to that of FIG. 1 shown exploded.

Turning now to the drawings in greater detail, there is illustrated in FIGS. 1 and 2 an assembly including a pallet system 20 within which various features of the present invention are incorporated. The system 20 is illustrated as supporting a relatively large number of strand material packages such as yarn bobbins 24 in a compact arrangement for warehousing and/or transporting purposes. However, a system in accordance with the broader aspects of the invention may be utilized for supporting virtually any type of load normally supported by a pallet for warehousing and/or transporting purposes. Accordingly, the principles of the present invention may be variously applied.

As best shown in FIG. 2, each bobbin 24 is elongated in shape and includes a central tube 26 about which yarn 28 is wound so that each of the opposite ends of the bobbin 24 is circular and the outer shape of the bobbin 24 is frustoconical in form. Consequently, one of the ends of each bobbin 24 is slightly larger in diameter than that of the opposite bobbin end. When each bobbin 24 is positioned within the pallet system 20 in a manner described herein, the tube 26 is arranged substantially vertically so that one of its ends is a lower end and the other of its ends is an upper end. The bobbins 24 are arranged in layers 25, 27, and the layers 25, 27 are, in turn, arranged in a stacked relationship.

The system 20 includes a first lower section 30, a second lower section 32, a pair of dividers 33, 35, and a cap 34. With the two layers 25, 27 of yarn bobbins 24 palletized within the system 20, the bobbin layer 25 engageably overlies the first and second sections 30, 32, the dividers 33, 35 engageably overlie the bobbin layer 25, the bobbin layer 27 engageably overlies the dividers 33, 35, and the cap 34 engageably overlies the bobbin layer 27.

Figure 3:
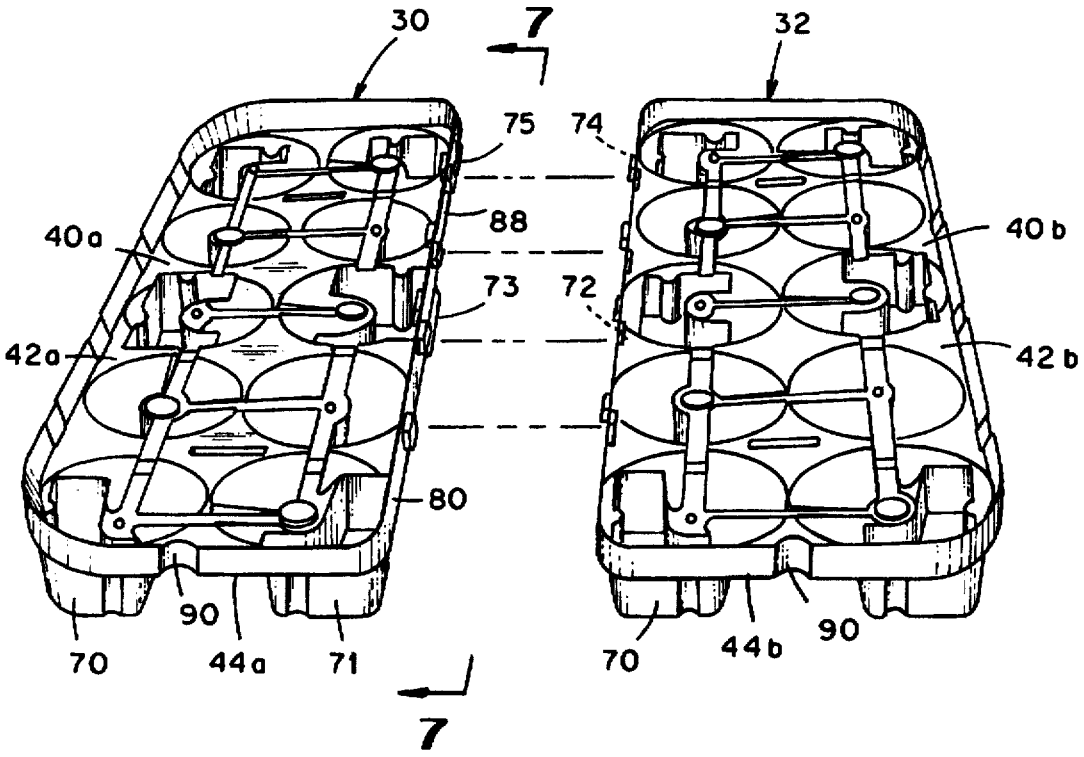
FIG. 3 is a perspective view of the lower platform sections of the FIG. 1 pallet system shown separated from one another.
Figure 4:
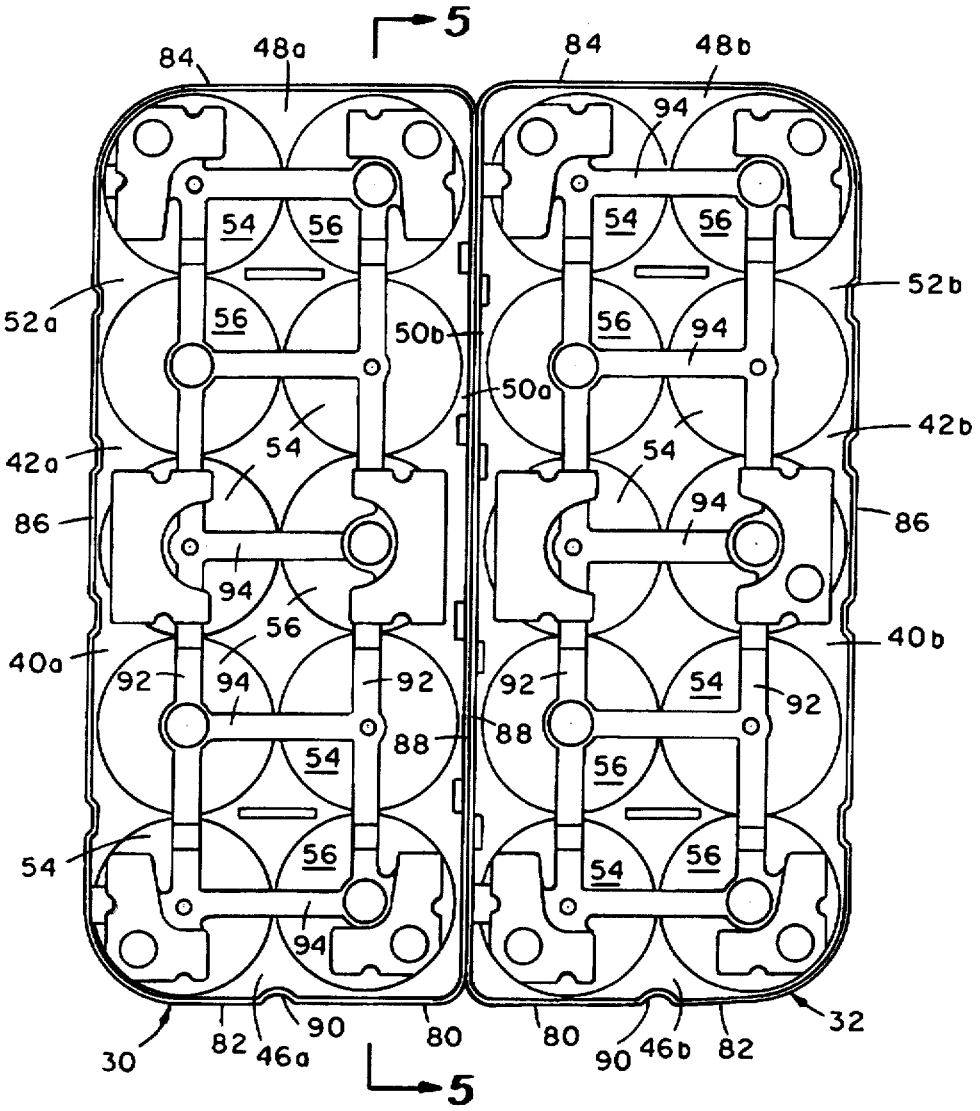
FIG. 4 is a top plan view of the FIG. 3 sections when the sections are positioned in a side-by-side relationship.
Figure 5:
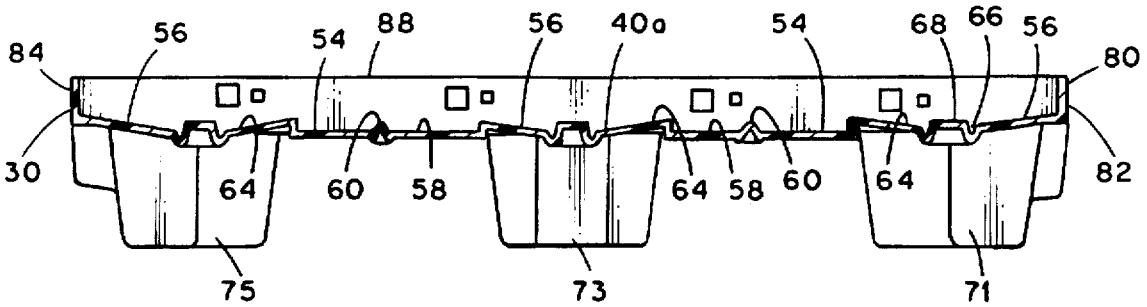
FIG. 5 is a cross-sectional view taken along cutting plane 5—5 of FIG. 4.

As best shown in FIGS. 3–5, each of the first and second sections 30, 32 includes a platform portion 40*a* or 40*b* providing a generally upwardly-facing surface 42*a* or 42*b* for supporting the bobbin layer 25 and an underside surface 44*a* or 44*b* opposite the upwardly-facing surface 42*a* or 42*b*. In the system 20, each upwardly-facing surface 42*a* or 42*b* is substantially rectangular in shape as viewed in the plan view of FIG. 4 so that the perimeter of each surface 42*a* or 42*b* includes two opposite or parallel ends 46*a*, 48*a* or 46*b*, 48*b* and two opposite end parallel sides 50*a*, 52*b* or 50*a*, 52*b* extending between the ends 46*a*, 46*b* or 48*a*, 48*b*. For a reason apparent herein, the width of the upwardly-facing surface 42 as measured across each end 46*a*, 48*a* or 46*a*, 48*b* is less than about one-half the length of the upwardly-facing surface 42*a* or 42*b* as measured along each side 50*a*, 52*a* or 50*a*, 52*b*.

Each upwardly-facing surface 42*a* or 42*b* includes a plurality of recesses 54 or 56 for accepting the lower ends of the yarn bobbins 24 when positioned therein so that when accepted by the recesses 54 or 56, the bobbins 24 are relatively stable. To this end, each recess 54 or 56 is shaped generally complimentary to the shape of the bobbin end which it is adapted to accept. For accepting the larger end of a bobbin 24, each recess 54 includes a circular, substantially flat bottom 58 for underlying the bobbin 24 and upwardly-extending projection 60 positioned centrally of the bottom 58 for receipt by the corresponding end of the bobbin tube 26 positioned within the recess 54. For accepting the smaller end of the bobbin 24, each recess 56 includes a circular, somewhat concave bottom 64 for underlying the bobbin 24 and a central ring-like depression 66 for accepting the corresponding end of the bobbin tube 26. Each recess 56 also includes a middle portion 68 which extends upwardly from the center of the depression 66 for receipt by the end of the bobbin tube 26 positioned within the depression 66.

As viewed in the plan view of FIG. 4, the recesses 54 and 56 are arranged across the upwardly-facing surface 42*a* or 42*b* in two rows and so that the recesses 54 alternate with the recesses 56 along each row. Therefore, when the bobbins 24 are positioned within the recesses 54 and 56 in the manner illustrated in FIG. 1, the bobbins 24 which are arranged large-end-up in each row alternate with the bobbins 24 which are arranged large-end-down in each row.

Figure 6:
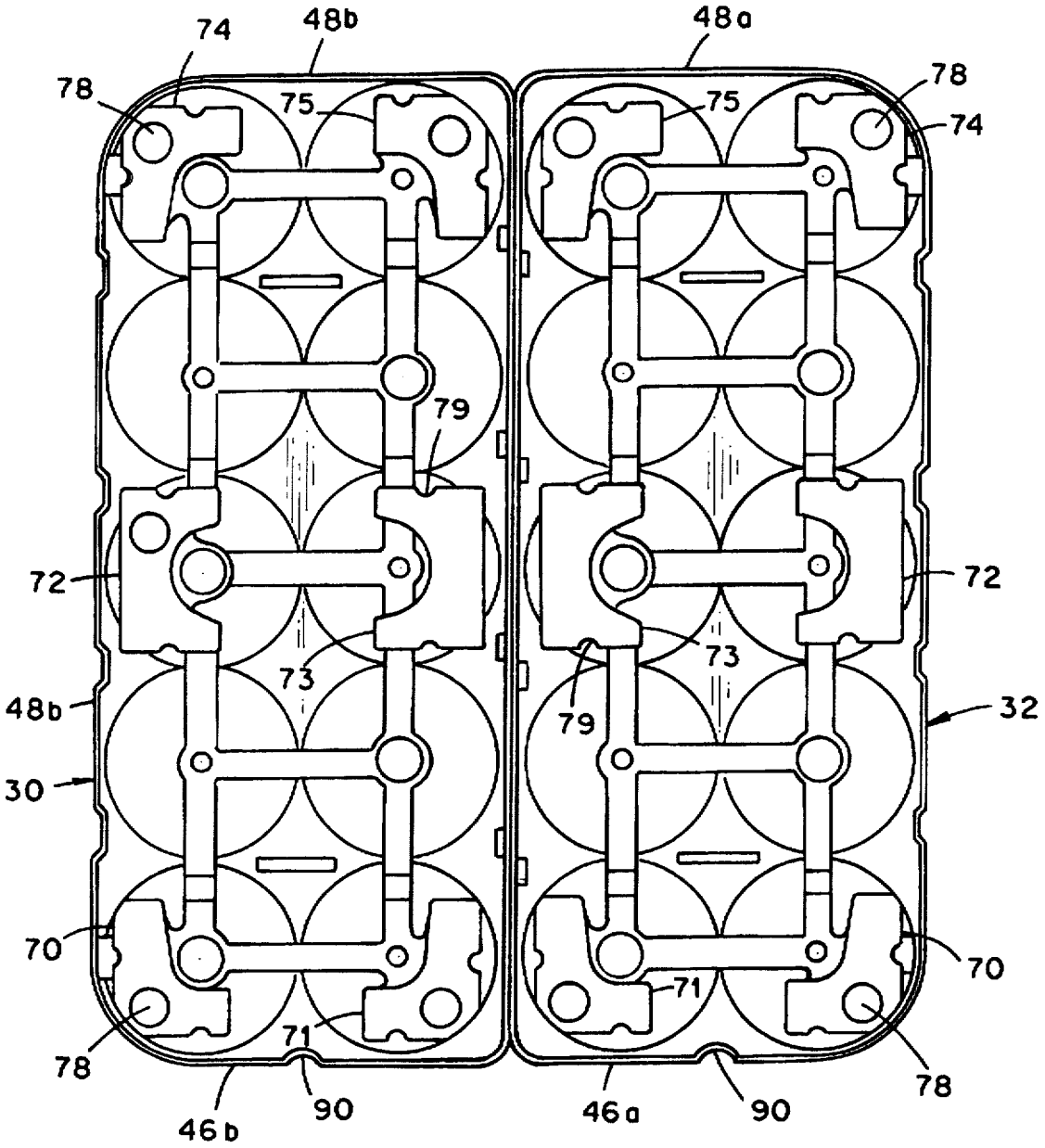
FIG. 6 is a bottom plan view of the FIG. 3 sections when the sections are positioned in a side-by-side relationship.

With references to FIG. 6, each section 30 or 32 also includes six feet 70–75 joined to the platform portion 40*a* or 40*b* for supporting the underside surface 44*a* or 44*b* thereof in an elevated condition above a floor 76 (FIG. 1) or other supporting surface. Two feet 70, 71 are arranged adjacent one end 46*a* or 46*b* of the upwardly-facing surface 42*a* or 42*b*, two feet 74, 75 are arranged adjacent the other end 48*a* or 48*b* of the surface 42*a* or 42*b*, and each of the remaining two feet 72, 73 are arranged substantially midway between the feet arranged adjacent the section ends. In addition, the feet 70, 72, 74 and feet 71, 73, 75 are in spaced relation along the length of each side of its corresponding section so that the spacing provided between each pair of adjacent feet accepts the lift, i.e., fork, of a lift truck directed beneath the underside surface 44*a* or 44*b* from either side of the section 30 or 32. Similarly, the feet 70, 72, 74 positioned along one side of each section 30 or 32 are spaced from the feet 71, 73, 75 positioned along the other side of the corresponding section 30 or 32 so that the spacing provided therebetween accepts the lift of a lift truck directed beneath the underside surface 44*a* or 44*b* from either end of the section 30 or 32. For a reason apparent herein and as shown in FIG. 6, the bottom of each foot 70 and 74 located adjacent an end of each section 30 or 32 includes a downwardly-opening depression 78, and the side of each foot 73 includes an outwardly-opening recess 79.

Figure 7:
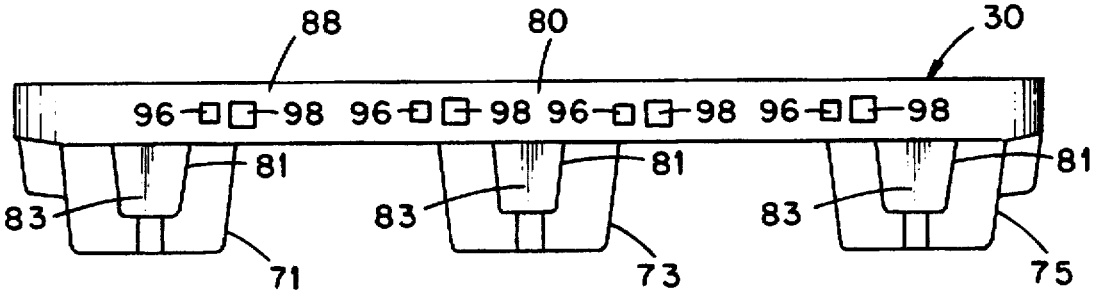
FIG. 7 is a side elevation view of one of the FIG. 3 sections as viewed along cutting plane 7—7 of FIG. 3.
Figure 8:
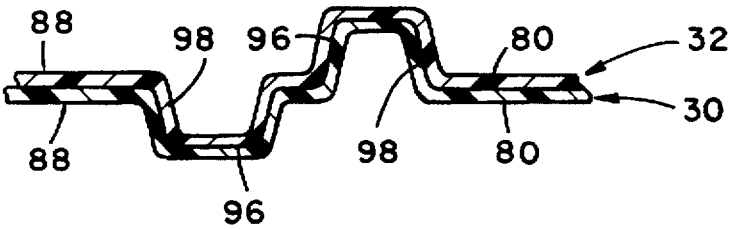
FIG. 8 is a fragmentary cross-sectional view taken along cutting plane 8—8 of FIG. 2.

With reference to FIGS. 4, 5 and 7, each of the first and second sections 30 or 32 also includes an upwardly-extending lip 80 joined to the platform portion 40*a* or 40*b* so as to extend completely around the perimeter of the upwardly-facing surface 42*a* or 42*b*. Each lip 80 includes end portions 82, 84 which extend along each end of the corresponding upwardly-facing surface 42*a* or 42*b* and opposite side portions 86, 88 which extend between the end portions 82, 84. Provided along the length of each lip end portion 82 is an arcuate section 90 for a reason apparent herein. The height of each lip 80 as measured from the corresponding upwardly-facing surface 42*a* or 42*b* is sufficient to prevent the bobbins 24 from slipping off of the upwardly-facing surface 42*a* or 42*b*. For a reason apparent herein, each foot 71, 73 or 75 includes an outwardly-protruding rib 81 having a flat side surface 83 which is arranged generally in the plane of the lip side portion 88.

Each of the first and second sections 30 or 32 is molded as a single unit out of a relatively hard plastic. For purposes of rigidifying the platform portion 40*a* or 40*b*, each section 30 or 32 includes a network of longitudinally-extending ribs 92 and transversely-extending ribs 94 integrally formed within the platform portion 40*a* or 40*b*. In addition, each of the feet 70–75 is molded so as to include a hollow interior which opens upwardly out of the corresponding upwardly-facing surface 42*a* or 42*b*.

Figure 9:
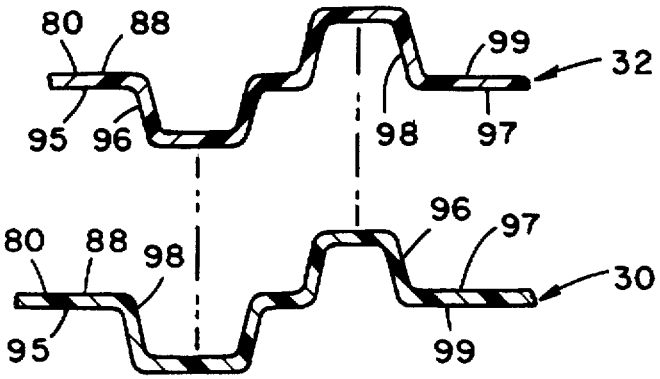
FIG. 9 is a view similar to that of FIG. 8, shown exploded.

It is a feature of the system 20 that the first and second sections 30, 32 can be placed in a side-by-side relationship so that movement of the sections 30, 32 relative to one another is limited. In this connection, and as best viewed in FIGS. 6–9, each side portion 88 of the lip 80 includes a vertical wall 95 having opposite outwardly and inwardly-facing surfaces 97 and 99, respectively, a plurality of protuberances 96 which extend outwardly from the outwardly-facing surfaces 97 and 99, respectively, a plurality of protuberances 96 which extend outwardly from the outwardly-facing surface 97 and a plurality of recesses 98 which open out of the outwardly-facing surface 97. In the depicted embodiment sections 30, 32, there are four protuberances 96 which are regularly spaced along the length of the lip side portion 88 and one recess 98 positioned to one side of each protuberance 96. As best shown in FIG. 9, each protuberance 96 is provided by an indentation which has been formed in the lip side portion 88 so that each protuberance 96 projects to one side of the section 30 or 32, and each recess 98 is provided by another indentation which has been formed in the lip side portion 88 so that the opening of each recess 98 opens to one side of the section 30 or 32. In the depicted sections 30, 32, each protuberance 96 and opening provided by each recess 98 is substantially rectangular in cross section, but these protuberances and openings may possess any cross-sectional shape in accordance with the broader aspects of this invention.

The protuberances 96 and recesses 98 are disposed along the length of each lip side portion 88 for receipt by or acceptance within a corresponding recess 98 or protuberance 96 provided in the lip side section 88 of the other section 32 or 30. Accordingly, the recesses 98 of each section 30 or 32 are sized to nestingly accept the protuberances 96 of the other section 32 or 30. With the two sections 30, 32 positioned alongside one another as shown in FIG. 4 so that the protuberances 96 of one section 30 or 32 are accepted by the recesses 98 provided in the other section 32 or 30, the sections 30, 32 collectively provide a relatively large support surface upon which yarn bobbins 24 may be positioned.

If it is desired that the sections 30, 32 be moved together by a lift truck, the lift of the lift truck may be positioned beneath both of the platform portions 40*a* and 40*b* for simultaneously lifting and transporting the sections 30, 32 as a single unit. When moving the sections 30, 32 as a single unit, the interlocked protuberances 96 and recesses 98 resist longitudinal and vertical shifting of the sections 30, 32 relative to one another and are advantageous in this respect. If the sections 30, 32 are lifted together by forks directed beneath the ends of the sections 30, 32, the surfaces 83 of the feet ribs 82 of the sections 30, 32 abut one another and resist any likelihood of the sections 30, 32 to bow along the ends thereof. In other words, the ribs 82 help to maintain the platform surfaces 42*a*, 42*b* in a common plane when lifted with the forks of a lift truck.

If, on the other hand, it is desired to move only one section 30 or 32 at a time, the lift forks of a lift truck may be positioned beneath the platform portion 40*a* or 40*b* of one section 30 or 32 for lifting only that one section 30 or 32. By subsequently lifting the selected section 30 or 32 by that slight amount required for the feet 70–75 to clear the underlying floor 76 (FIG. 1), the lifted section 30 or 32 may be laterally moved away from the other section 32 or 30 so that the protuberances 96 of the lifted section 30 or 32 withdraw from the recesses 98 of the other section 32 or 30. In the depicted system 20, the width of each section 30 or 32 as measured across its end 82 or 84 is about twenty-two inches so that with one section 30 or 32 may be moved endwise along a creel aisle of typical width, e.g. about two feet in width.

Figure 12:
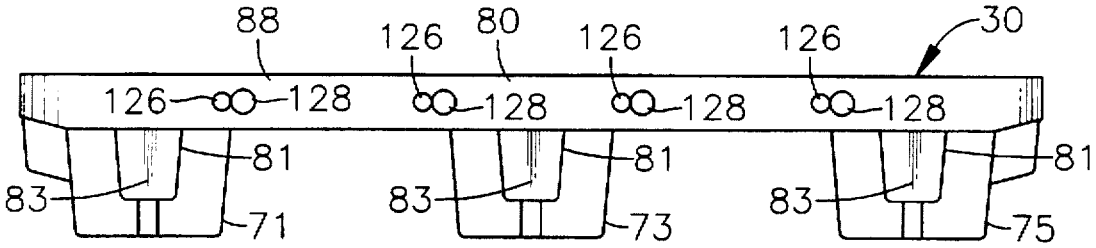
FIG. 12 is a side elevational view of an alternative embodiment of the invention.
Figure 13:
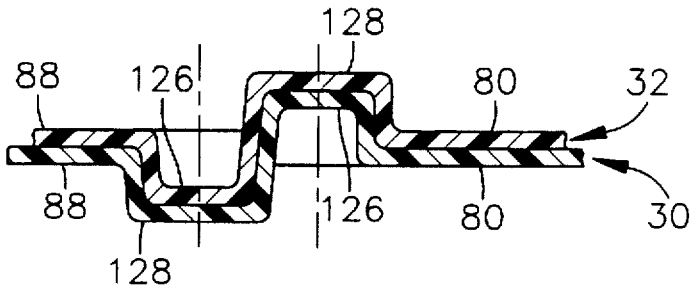
FIG. 13 is a fragmentary cross-sectional view taken along cutting plane 13—13 of FIG. 12.
Figure 14:
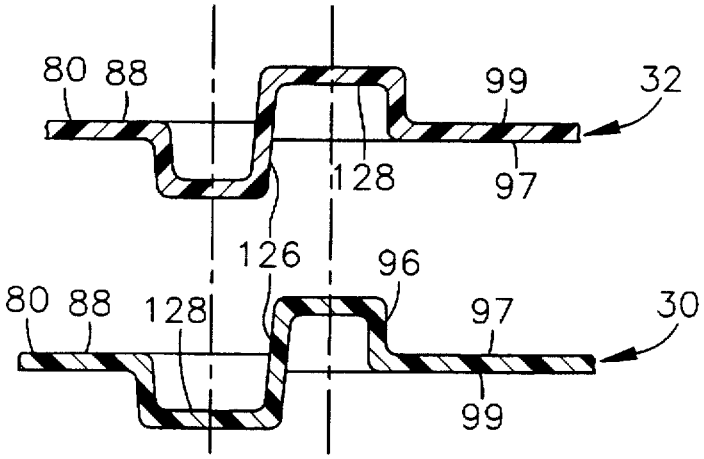
FIG. 14 is a view similar to that of FIG. 13, shown exploded.

FIGS. 12, 13 and 14 illustrate an alternative embodiment of interlocking protuberance and recess structure comprising a substantially cylindrical plug 126 of substantially circular cross-section that is cooperatively dimensioned to socket into a substantially cylindrical receptacle 128 of substantially circular cross-section. This embodiment of the invention aligns a plug 126 laterally with a cooperative receptacle 128 at relative tangency whereby at least one cylindrical surface element transverse of the lip side section is common to both, the plug 126 and the receptacle 128.

With reference again to FIGS. 1 and 2, each divider 33 or 35 includes a substantially rectangular platen portion 100 and a downwardly-directed lip 102 joined to so as to extend around the perimeter of the platen portion 100. In use, each divider 33 or 35 physically separates the bobbins 24 of the lower layer 25 from the bobbins 24 of the upper layer 27 and is disposed directly above the upwardly-facing surface 42*a* or 42*b* of a corresponding one of the lower sections 30 or 32. Accordingly, the outer dimensions of the platen portion 100 of each divider 33 or 35 approximates those of the upwardly-facing surface 42*a* or 42*b* of the corresponding lower section 30 or 32. The platen portion 100 and lip 102 of each divider 32 or 35 are relatively thin and molded as a single unit out of a relatively hard plastic. To help rigidify each divider 33 or 35, the platen portion 100 is formed with alternating raised and lowered sections disposed across the surface of the platen portion 100.

Figure 10:
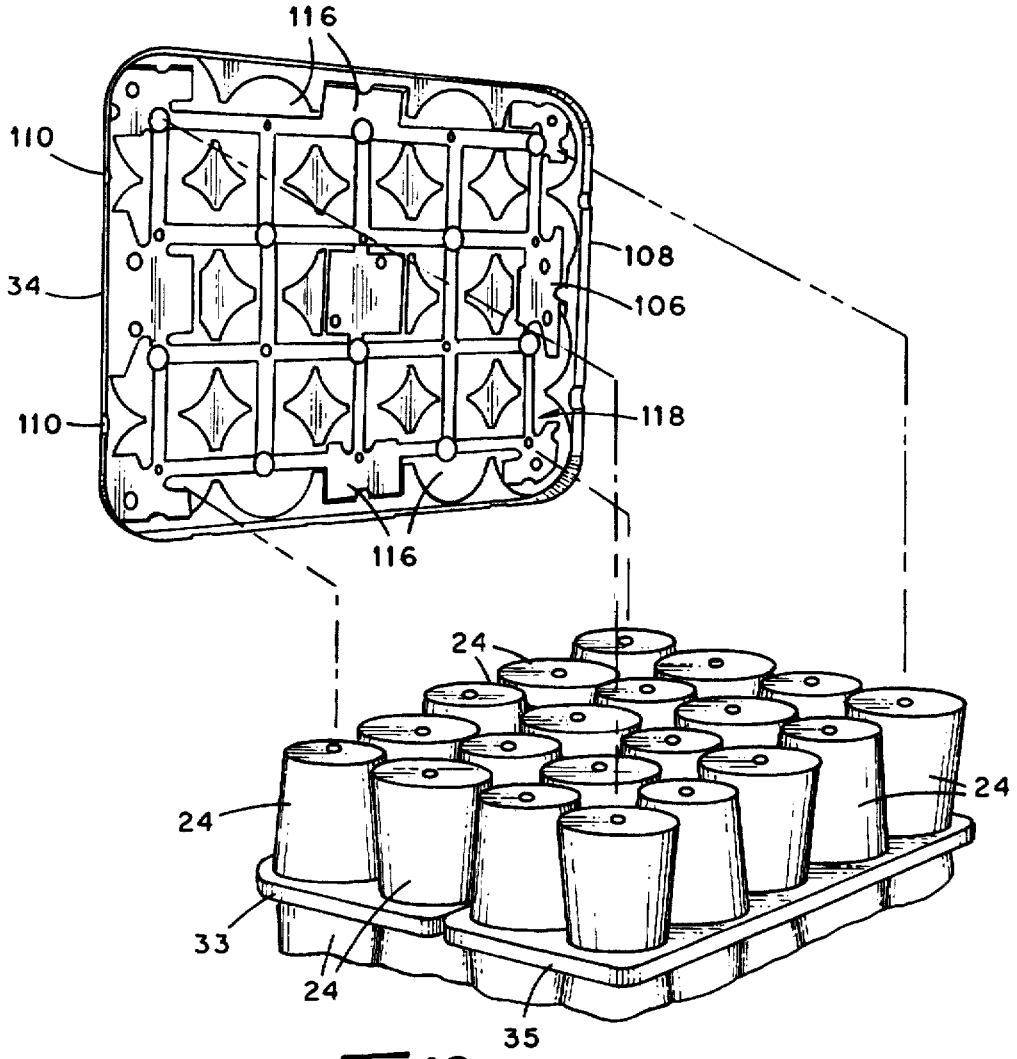
FIG. 10 is a fragmentary perspective view of the FIG. 1 assembly illustrating the cap of the pallet system when removed from the top of the yarn bobbins.

With reference to FIGS. 1, 2 and 10, the cap 34 of the system 20 includes an expansive platen portion 106 and a downwardly-extending lip 108 joined to so as to extend around the perimeter of the platen portion 106. In use, the cap 34 overlies so as to cover all of the bobbins 24 of the upper layer 27. Accordingly, the outer dimensions of the platen portion 106 approximate those of the expansive support surface collectively provided by the upwardly-facing surfaces 42*a* and 42*b* of the lower sections 30, 32.

The platen portion 106 and lip 108 of the cap 34 are relatively thin and molded as a single unit out of a relatively hard plastic. A plurality of downwardly-opening circular recesses are formed in the platen portion 106 for receiving the upper ends of the bobbins 24 of the upper layer 27. In addition, a network 118 of transversely-extending and longitudinally-extending ribs are integrally formed in the platen portion 106 to rigidify the cap 34. The lip 108 includes a pair of arcuate portions 110 disposed at one end of the cap 34.

Figure 11:
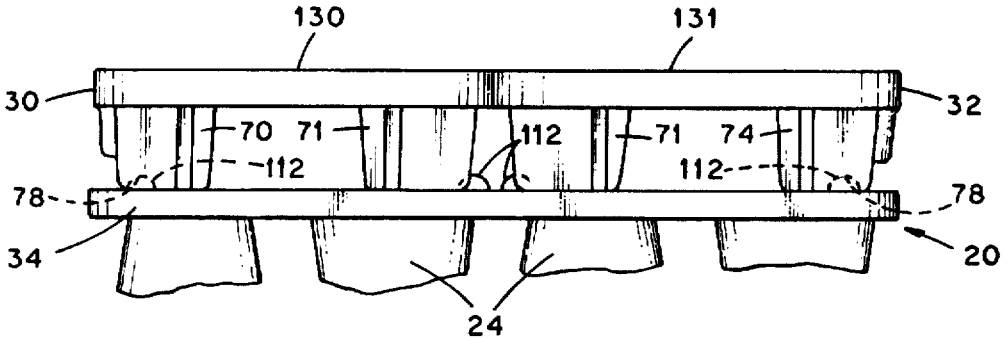
FIG. 11 is a fragmentary end elevation view of the FIG. 1 assembly shown underlying a pallet system of like construction to that of the FIG. 1 assembly.

It is another feature of the system 20 that the system 20 may be stacked with a system of like construction in a manner which prevents the slipping or shifting of the superposed system relative to the underlying system. To this end, the cap 34 includes a plurality of protuberances 112 disposed across the upper surface of the platen portion 106 so as to extend upwardly therefrom. When a pair of sections, indicated 130 and 132 in FIG. 11 and identical in construction to that of the lower sections 30, 32 of the FIG. 1 system 30, are stacked upon the cap 34, the protuberances 112 are either received by the downwardly-opening depression 78 formed in the feet 70, 74 of the superposed sections 130, 132 or the recess 79 provided in one side of each foot 73 so that the sections are prevented from shifting across the upper surface of the cap 34. Accordingly, the protuberances 112 are disposed across the platen portion 106 at locations which are in vertical registry, as shown in FIG. 2, with the downwardly-opening depressions 78 formed in the feet 70, 74 and the recesses 79 provided in the feet 73.

The system 20 provides a further advantage in that the arcuate portions 90 and 110 provided in the lip 80 of the lower sections 30, 32 and lip 108 of the cap 34 facilitate the putting together of the assembly components in a proper arrangement for palletizing the yarn bobbins 24. More specifically, since the recesses 54, 56 of the lower sections 30, 32 (which recesses alternate along the length of each longitudinally-extending and each traversely-extending row) and those of the cap 34 are shaped to accept a corresponding end of a bobbin 24, the arrangement of recesses (i.e. four rows with five recesses each) permits the cap 34 to be fitted upon the bobbins 24 in only one orientation. The arcuate portions 90 or 110 are provided in a predetermined end of each assembly component so that the arcuate portions 90, 110 must be positioned on the same end of the assembly when the assembly components are assembled. Therefore, when an operator is arranging the lower sections 30, 32 and cap 34 in the proper relationship for palletizing the yarn bobbins 24, the operator need only ensure that the arcuate portions 90 and 110 are disposed at the same end of the assembly.

If it is desired to band the palletized bobbins, a pair of bands 114 (FIG. 1) may be tightly looped about the system 20 so as to encircle the cap 34 and lower sections 30, 32. Alternatively, the system 20 may be unitized with a wrapped or layered envelopment of thermoplastic polymer film.

It follows from the foregoing that the aforedescribed system 20 accomplishes its intended objects. In particular, the system 20 includes interconnecting lower sections 30, 32 which, when interconnected, provide an expansive load-supported surface upon which a relatively large number of strand material packages, such as yarn bobbins 24, may be positioned and which, when detached or separated from one another, may be moved independently of the other section. Another advantage of the detachability of the lower sections 30, 32, in addition to the capacity of the sections 30, 32 to be separately transported along aisles of narrow width, relates to the optimizing of use of the floor space available in a warehouse or truck van for placement of loaded pallets thereon. For example, the floor space of a warehouse or van may not be dimensioned to accept a number of loaded systems 20 without unused floor space being left over. By separating the loaded lower sections 30, 32 from one another and then positioning the sections 30, 32 one-at-a-time within the warehouse or van, additional loaded material may be placed within the warehouse or van to utilize the space which would otherwise be left unused.

It will be understood that numerous modifications and substitutions may be had to the aforedescribed embodiment without departing from the spirit of the invention. For example, although the aforedescribed system 20 has been shown and described as including a pair of dividers 33, 35 for separating layers 25 and 27 of bobbins 24 from one another, a system in accordance with the present invention upon which a single layer of yarn bobbins are palletized need not include such dividers. Furthermore, although the lips 80, 108 of the lower sections 30, 32 and cap 34 have been shown and described as including arcuate portions 90, 110 for visually indicating to an operator that the system components are properly arranged when the arcuate portions 90, 110 are positioned on the same end of the assembly, other indicia, such as a stripe, may be borne by the appropriate ends of the lips 80, 108. Accordingly, the aforedescribed embodiment 20 is intended for the purpose of illustration and not as limitation.

I claim:

1. A pallet system for use in the warehousing or transporting of loads comprising:

first and second sections, each section including; a) a platform portion having an upwardly-facing surface upon which a load can be positioned and having an underside surface opposite said upwardly-facing surface against which the lift of a lift truck may be positioned for lifting the section, said upwardly-facing surface having a perimeter with one side extending therealong and sized so that when the first and second sections are positioned in a side-by-side relationship, the upwardly-facing surfaces collectively provide an expansive surface for supporting a load positioned thereon; b) a plurality of feet associated with the platform portion for supporting the underside thereof in an elevated condition above a floor or similar support surface and disposed in a spaced relationship about the perimeter of the upwardly-facing surface so that the spacing provided between adjacent feet accepts the lift forks of a lift truck directed beneath the underside of the platform portion for lifting the section; and, c) means providing an upwardly-directed lip joined to the platform portion so as to extend along said one side of the perimeter of its upwardly-facing surface, the lip including a vertically-oriented wall having an outside surface which faces away from said one side of the corresponding section and at least one protuberance extending outwardly from said outside surface, said outside surface including at least one opening disposed along the length of the lip wall;

said first and second platform sections being positionable alongside one another so that the protuberances provided along the outside surface of the lip wall of one platform section are nestingly accepted by the openings provided along the outside surface of the lip wall of the other platform section for limiting the longitudinal and vertical movement of one platform section relative to the other platform section; and, each protuberance including a top surface and a bottom surface which each extend horizontally outwardly from the outside surface of its corresponding lip and each opening which is provided along the length of the outside surface of its corresponding lip includes a horizontal upper edge and a horizontal lower edge for cooperating with a corresponding one of the protuberance top surface and protuberance bottom surface when the opening nestingly accepts a protuberance so that when the first and second sections are positioned alongside one another so that each protuberance of one section is nestingly accepted by a corresponding opening of the other section and the sections are urged vertically relative to one another, the protuberances resist dislodgement from the openings.

2. The system as defined in claim 1 wherein said outside surface of said lip wall includes a plurality of recesses opening outwardly of said outside surface and the aforesaid openings in said outside surface are provided by the openings of said recesses.

3. The system as defined in claim 1 wherein there are four protuberances which are regularly spaced along the length of the lip wall and four openings which are regularly spaced along the length of the lip wall.

4. The system as defined in claim 1 wherein each of the protuberances and the openings in said outside surface are substantially rectangular in cross-section.

5. The system as defined by claim 1 wherein each of the protuberances and the openings in said outside surface are substantially circular in cross-section.

6. The system as defined in claim 1 wherein the load desired to be supported by said pallet system is comprised of a plurality of strand material packages such as yarn bobbins, cones and pirns, each lip extends completely around the perimeter of the corresponding upwardly-facing surface, and each upwardly-facing surface includes a plurality of recesses disposed thereover for accepting an end of a strand material package positioned thereupon.

7. The system as defined in claim 1 further including a relatively rigid cap for covering the load positioned upon the first and second sections.

8. The system as defined in claim 7 wherein the cap defines a top surface which faces generally upwardly and upon which a pallet system of like construction can be positioned so that the feet of the pallet system of like construction engageably overlie the top surface, said cap including means for preventing movement of the pallet system of like construction relative to and across the top surface.

9. The system as defined in claim 8 wherein the cap includes a plurality of upwardly-directed protuberances disposed across its top surface so that when the pallet system of like construction is positioned upon said cap, said upwardly-directed protuberances cooperate with the feet of the pallet system of like construction to prevent the pallet system of like construction from moving relative to and across the top surface.

10. The system as defined in claim 9 wherein each of at least two feet of the first and second sections include a downwardly-opening recess for receiving a corresponding one of the upwardly-directed protuberances of a cap of a pallet system of like construction when the first and second sections of the system are positioned upon the cap of a pallet system of like construction.

11. The system as defined in claim 1 wherein the first and second sections are constructed so that the sections must be arranged in a predetermined side-by-side relationship before the protuberances provided along the outside surface of the one lip wall of one platform section can be moved into the recesses provided along the lip wall of the other platform section, and each lip has an end portion which extends across one of the ends of the perimeters of its corresponding section and said end portion includes indicia-providing means for visually indicating to a user viewing the ends of the first and second sections when positioned in the predetermined side-by-side relationship that the first and second sections are in the predetermined relationship for acceptance of the protuberances provided along the outside surface of the lip wall of one section by the openings provided along the outside surface of the lip wall of the other platform section.

12. A pallet system within which strand material packages such as yarn bobbins, cones and pirns can be palletized comprising:

first and second sections, each section including; a) a platform portion having an upwardly-facing surface upon which a plurality of strand material packages can be positioned and having an underside opposite said upwardly-facing surface against which the lift of a lift truck may be positioned for lifting the section, said upwardly-facing surface having a perimeter with one side extending therealong and sized so that when the first and second sections are positioned in a side-by-side relationship, the upwardly-facing surfaces collectively provide an expansive surface for supporting strand material packages positioned thereon and when the first and second sections are separated from one another, each of the sections can be moved endwise along a creel aisle of relatively narrow width. b) a plurality of feet associated with the platform portion for supporting the underside thereof in an elevated condition above a floor or similar support surface and disposed in a spaced relationship about the perimeter of the upwardly-facing surface so that the spacing provided between adjacent feet accepts the lift forks of a lift truck directed beneath the underside of the platform portion for lifting the section; and, c) means providing an upwardly-directed lip joined to the platform portion so as to extend around the perimeter of its upwardly-facing surface, the lip having a side portion extending along said one side of the perimeter including a vertically-oriented wall having an outside surface which faces away from one side of the corresponding section, an inside surface opposite said outside surface, and a plurality of protuberances extending outwardly from said outside surface, said outside surface including a plurality of openings disposed along the length of said vertically-oriented wall, each protuberance including a top surface and a bottom surface wherein each of the top and bottom surfaces extends horizontally outwardly from the outside surface of its corresponding lip wall and each opening which is provided along the length of the outside surface of its corresponding lip wall includes an upper edge and a lower edge wherein each edge extends horizontally inwardly from the outside surface of its corresponding lip wall for cooperating with a corresponding one of the protuberance top surface and protuberance bottom surface so that when the first and second platform sections are positioned alongside one another so that the protuberances of one platform section are nestingly accepted by the openings of the other platform section and the platform sections are urged vertically relative to one another, the protuberances resist dislodgement from the openings; and, a relatively rigid cap positionable across the strand material packages positioned upon the first and second sections so as to cover the strand material packages when the first and second sections are positioned alongside one another so that the protuberances provided along the lip wall of one section are accepted by the openings provided along the lip wall of the other section, said cap including a platen portion having a perimeter and a downwardly-directed lip joined to the platen portion so as to extend around the perimeter thereof.

13. The system as defined in claim 12 wherein said outside surface of said lip wall includes a plurality of recesses opening outwardly of said outside surface and the aforesaid openings in said outside surface are provided by the openings of said recesses.

14. The system as defined in claim 12 wherein each of the protuberances and the openings in said vertically-oriented wall are substantially rectangular in cross-section.

15. The system as defined in claim 12 wherein each of the protuberances and the openings in said vertically-oriented wall are substantially circular in cross-section.

16. The system as defined in claim 12 wherein the upwardly-facing surface of each platform portion includes a plurality of recesses disposed thereover for accepting an end of a strand material package positioned thereupon, and the platen portion of said cap includes a downwardly-facing surface having a plurality of recesses disposed thereacross for accepting an end of a strand material package across which the cap is positionable.

17. The system as defined in claim 12 wherein the cap defines a top surface which faces generally upwardly and upon which a pallet system of like construction can be positioned so that the feet of the pallet system of like construction engageably overlie the top surface, said cap including means for preventing movement of the pallet system of like construction relative to and across the top surface.

18. The system as defined in claim 17 wherein the cap includes a plurality of upwardly-directed protuberances disposed across its top surface so that when the pallet system of like construction is positioned upon said cap, said upwardly-directed protuberances cooperate with the feet of the pallet system of like construction to prevent the pallet system of like construction from moving relative to and across the top surface.

19. The system as defined in claim 18 wherein each of at least two feet of the first and second sections include a downwardly-opening recess for receiving a corresponding one of the upwardly-directed protuberances of a cap of a pallet system of like construction when the first and second sections of the system are positioned upon the cap of a pallet system of like construction.

* * * * *

UNITED STATES PATENT AND TRADEMARK OFFICE

CERTIFICATE OF CORRECTION

PATENT NO. : 5,758,771

DATED : June 2, 1998

INVENTOR(S) : Henry H. Rose

It is certified that error appears in the above-indentified patent and that said Letters Patent is hereby corrected as shown below:

Column 1, line 33, before "relatively", insert --a--.

Column 1, lines 39 and 40, delete "an optimizing of" and insert --optimum-- therefor.

Column 3, line 21, after "50a" (first occurrence) delete "52b" and insert --52a-- therefor.

Column 3, line 21, delete the second occurrence of "50a" and insert --50b-- therefor.

Column 3, line 22, delete "46b" and insert --48a-- therefor.

UNITED STATES PATENT AND TRADEMARK OFFICE

CERTIFICATE OF CORRECTION

PATENT NO. : 5,758,771

DATED : June 2, 1998

INVENTOR(S) : Henry H. Rose

It is certified that error appears in the above-indentified patent and that said Letters Patent is hereby corrected as shown below:

Column 3, line 22, delete "48a" and insert --46b-- therefor.

Column 3, line 24, delete the second occurrence of "46a" and insert --46b-- therefor.

Column 3, line 27, delete "50a" and insert --50b-- therefor.

Column 5, line 55, delete the first occurrence of "to".

Signed and Sealed this

Twenty-fifth Day of August, 1998

Bruce Lehman

*Attest:*

BRUCE LEHMAN

*Attesting Officer*

*Commissioner of Patents and Trademarks*